US006484553B1

(12) United States Patent
Devers

(10) Patent No.: US 6,484,553 B1
(45) Date of Patent: Nov. 26, 2002

(54) SWAGE DIES FOR SWAGE-RING CLAMPS

(75) Inventor: Richard Allen Devers, Linwood, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/846,661

(22) Filed: May 1, 2001

(51) Int. Cl.[7] ..... B21D 39/04
(52) U.S. Cl. ..... 72/402; 29/237
(58) Field of Search ..... 72/402, 416, 409.19; 29/237

(56) References Cited

U.S. PATENT DOCUMENTS

| | | | | | |
|---|---|---|---|---|---|
| 3,695,087 | A | * | 10/1972 | Tuberman | 72/402 |
| 3,924,440 | A | * | 12/1975 | Vinje | 29/237 |
| 4,454,657 | A | * | 6/1984 | Yasumi | 72/402 |
| 4,614,107 | A | * | 9/1986 | Norin | 72/402 |
| 5,768,935 | A | * | 6/1998 | Owens | 29/237 |
| 6,044,681 | A | * | 4/2000 | Frenken | 29/237 |
| 6,176,116 | B1 | * | 1/2001 | Wilhelm et al. | 72/402 |

FOREIGN PATENT DOCUMENTS

| | | | | |
|---|---|---|---|---|
| DE | 1940854 | * | 10/1971 | 72/402 |
| GB | 567355 | * | 2/1945 | 72/402 |
| GB | 780204 | * | 7/1957 | 72/402 |
| GB | 1202431 | * | 8/1970 | 72/402 |
| SU | 893380 | * | 1/1982 | 72/402 |
| SU | 1003988 | * | 3/1983 | 72/402 |

* cited by examiner

*Primary Examiner*—Daniel C. Crane
(74) *Attorney, Agent, or Firm*—Edmond P. Anderson

(57) ABSTRACT

Apparatus for securing a seal to a substrate includes a plurality of swage dies having overlapped side surfaces configured to prevent clamp ring fold up between the swage dies.

3 Claims, 3 Drawing Sheets

SWAGE DIES FOR SWAGE-RING CLAMPS

FIELD OF THE INVENTION

This invention relates to swage apparatus for swaging a clamp ring against seal material to secure the seal material to a substrate.

DESCRIPTION OF THE PRIOR ART

Current apparatus for compressing seal material against an underlying substrate for producing a leak proof path therebetween, includes an apparatus having a plurality of pie-shaped swage segments that are operated by hydraulic or mechanical force to move the segments from a radially outwardly released position to a radially inwardly located force application position in which arcuate segments on each of the swage elements are mechanically forced against the outer circumference of a clamp ring for swaging the clamp ring into a compressed relationship with the seal material for securing it to a substrate such as a shaft.

The problem with such prior art arrangements is that a minimum clearance is provided between the opposed edges of the segments to insure that the hydraulic or mechanical force for swaging acts to compress the clamp ring rather than compressing the swage dies together. Such clearance can result in a plurality of circumferentially located folds or flashes in the resilient material clamped against the substrate.

The problem with such flash material is that it restricts the swage dies from fully closing to a desired dimension or force that will cause the clamp ring to be plastically deformed so as to reduce its inside diameter to compress the seal material between the clamp ring and the substrate. Such under swaging of a clamp ring can cause a fold up section of clamp and seal material to create a leakage path at the clamp ring.

SUMMARY OF THE INVENTION

The present invention solves the problem of such material clamp or seal material fold up by configuring the swage dies with a side edge configuration that will assure that the application of compression forces against each of the swage dies will be applied uniformly around the full circumference of a clamp ring so that it will be frilly plastically deformed in all sections of its inner diameter so as to prevent the problem of clamp ring fold-up or under compression of the seat material at folds between the clamp ring and the underlying substrate.

A feature of the invention is to provide apparatus for swaging clamps to secure seal material to an underlying substrate by uniform deformation of a ring clamp wherein the apparatus includes a plurality of swage dies arranged circumferentially of a clamp ring and having side surfaces thereon and the invention characterized by each of the plurality of swage dies having variable width side surfaces thereon that are overlapped for producing a uniform circumferential swaging force on the clamp ring during compression thereof against a seal material.

A further feature of the present invention is to provide such apparatus wherein the swage dies are even numbered.

A further feature is to provide such swage dies having truncated tapered face portions including side edge surfaces increasing in width toward the radially inner end of each of the swage dies; and wherein adjacent ones of the swage dies are alternately arranged to cause the overlapped surfaces to lie in substantially the same plane while providing an unrestricted radially inwardly and outwardly directed movement of each of the swage dies without application of compressive forces therebetween.

A further feature of the present invention is to provide apparatus having such swage dies wherein the swage dies have opposite faces thereon and wherein each of the opposite faces have one of the variable width side surfaces thereon and wherein the swage dies are even numbered.

A still further feature of the invention is to provide such apparatus wherein each of the dies have opposite faces thereon and each of the opposite faces have one of the variable width side surfaces thereon and swage dies are an odd number.

Still another object of the present invention is to provide such apparatus wherein each of the swage dies are pie-shaped and have overlapping side surfaces formed either partly along or fully along the full radial edge of each of the swage dies; and wherein the side surfaces of adjacent swage dies are overlapped to provide for uniform application of compression forces on the clamp ring without applying compressive forces between adjacent ones of the overlapped surfaces of each of the swage dies.

A still further feature of the present invention is to provide apparatus of the type set forth in the proceeding type wherein each of the overlapped side surfaces form a lap joint.

Still another feature is to provide such apparatus wherein the overlapped surfaces are substantially V-shaped.

Another feature of the present invention is to provide such apparatus wherein the overlapped surfaces are formed as a tongue-in-groove joint.

Other features of the invention will become apparent to those skilled in the art as a disclosure is made in the following detailed description of preferred embodiments of the invention as illustrated in accompanying sheets and drawings in which:

DETAILED DESCRIPTION OF PREFERRED EMBODIMENTS

Figure 1:
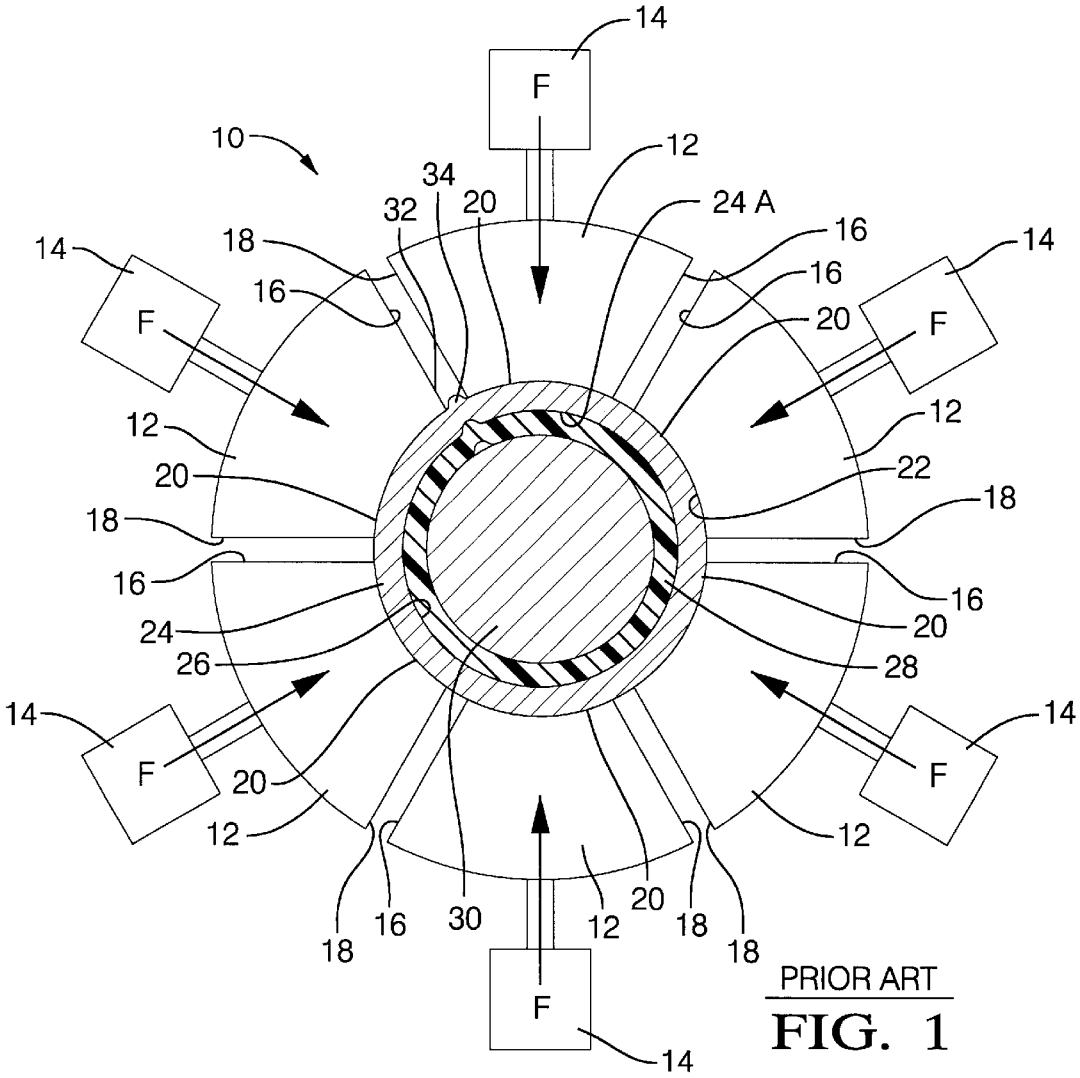
PRIOR ART FIG. 1
FIG. 1 is a diagrammatic view of the prior art clamp ring swage apparatus.

FIG. 1 shows a prior art swage apparatus 10 having 6 pie-shaped segments 12 that are operated radially inwardly and outwardly by suitable hydraulic or mechanical drivers shown by reference numeral 14. Each of the pie-shaped segments 12 have side edges 16, 18 that require some minimum clearance therebetween at a final swaging diameter which is diagrammatically shown in FIG. 1. At this position a radially inwardly arcuate surface 20 on each of the swage elements 12 is positioned against the outer circumference 22 of a clamp ring 24. The clamp ring 24 is compressed by the action of each of the swage dies 12 to be plastically deformed at its inside diameter 24*a*. The inside diameter 24*a* is thereby compressed against the outer surface 26 of a layer of seal material 28 for securing it in sealing engagement with an underlying substrate 30.

Such arrangements are found in a wide variety of seal applications, such as the seal between a CV joint boot and a halfshaft or prop shaft assembly; other examples of seal material held by a clamp ring against an underlying substrate include inflatable sleeves on load assist shock absorbers; seals on vehicular air springs; boot seals on transmission shift mechanism; seal elements connected between an outboard engine drive input and an output; and a wide variety of comparable seal arrangements where a clamp ring secures a resilient flexible seal element against an underlying substrate for producing a leak-proof joint therebetween.

Figure 2:
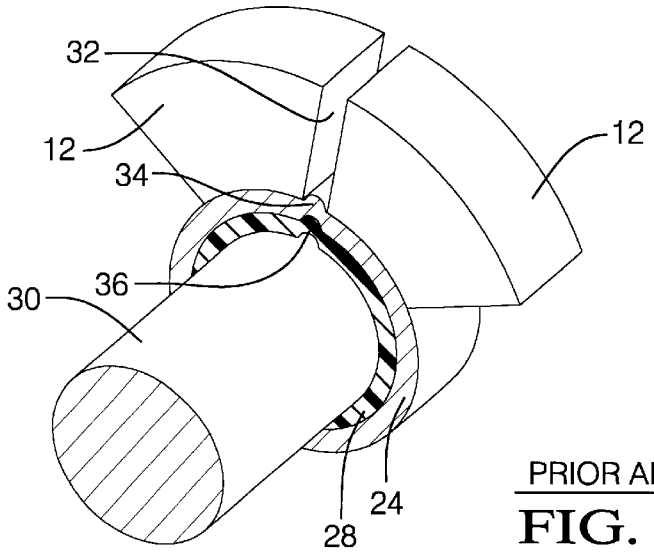
PRIOR ART FIG. 2
FIG. 2 is a fragmentary perspective view of the apparatus in FIG. 1.

The problem with such arrangements is that when the pie-shaped segments are in the fully applied position shown in FIG. 2, a minimum clearance space 32 between the segments at the final swaging diameter is provided to prevent excessive side compressive force action between each of the swage dies 12. However, in such arrangements there is a tendency for the compressed clamp ring 24 to fold up into the space 32 as shown at 34 to produce a slightly pushed-up section of the clamp as to result inadequate compression thereunder. The underlying seal material can also fold up as shown at 36. Such a fold can result in a leak path for fluids to escape across the joint, both inwardly and outwardly thereof. The folds 34, 36 are shown exaggerated in FIG. 2 for purposes of illustrating the problem.

Figure 3:
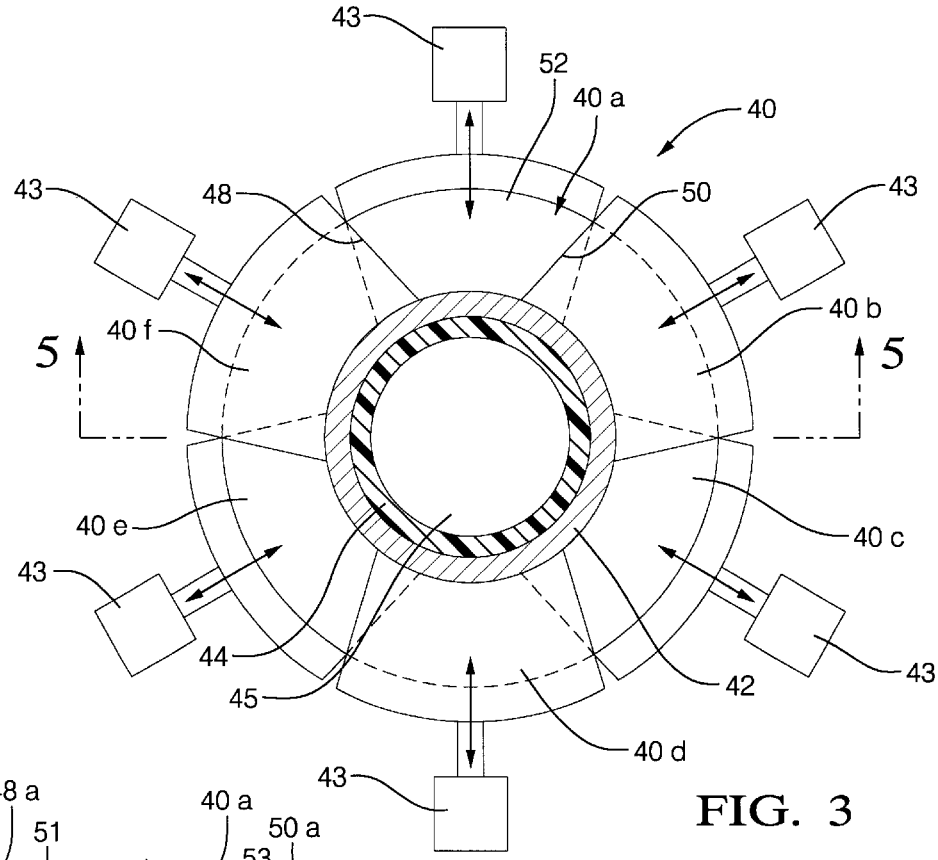
FIG. 3 is a diagrammatic view of a first embodiment of the present invention showing an even numbered swage die arrangement having the overlapped side edge configuration of the present invention.
Figure 4:
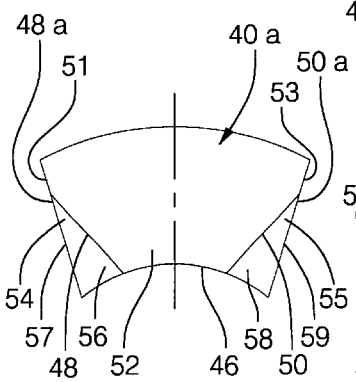
FIG. 4 is an elevational view of one swage element in the apparatus of FIG. 3.
Figure 5:
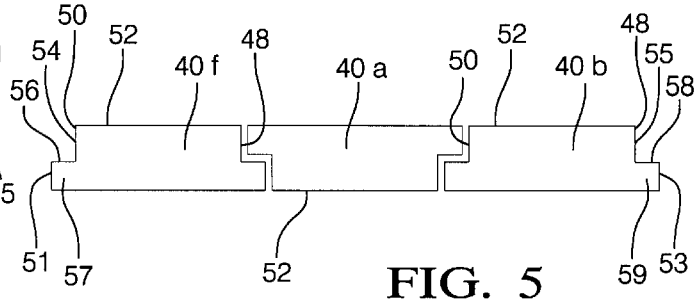
FIG. 5 is a fragmentary elevational view looking in the direction of the arrows 5—5 along the circumference of the apparatus in FIG. 3.

One embodiment of an apparatus 40 for swaging clamps in accordance with the present invention is shown in FIGS. 3–5. In this embodiment a plurality of swage dies 40*a* through 40*f* are arranged circumferentially around a clamp ring 42. The swage dies 40*a*–40*f* are connected to suitable drivers 43 so as to apply a radially inwardly directed force on the ring 42 to cause its inside diameter to be plastically deformed so as to compress a resilient seal element 44 with respect to underlying substrate 45.

Each of the swage dies 40*a* through 40*f* include a curved inner surface 46 and a pair of radially inwardly converging side surfaces 48, 50 that have a variable width from an apex 48*a* to a point on the curved surface 46 and from an apex 50*a* to the same curved surface 46. Each of the side surfaces 48, 50 are overlapped as shown in FIGS. 3 and 5. Between the side surfaces 48 and 50 is formed a truncated tapered face portion 52 that is bounded by the side surfaces 48, 50. As shown in FIG. 5, the overlapping swage dies (six in number) are arranged so that the truncated tapered surface portions 52 thereon are faced in an opposite direction from die to die as they are arranged circumferentially around the clamp ring 42. By virtue of this arrangement the overlapped side surfaces 48, 50 enable each of the dies to be fully contacted with the outer circumference of the clamp ring 44 to cause the swaging forces to be concentrated there against without a side compression loading on the dies and without formation of ring or seal folds found in the prior art arrangement. Specifically, this embodiment is configured so that the same number of dies will span a larger arc than in the prior art. Additionally, the space between the dies is not a straight edge surface, and as a consequence, it is more difficult for the clamp material to fold up into the space between the dies in a manner that restrict the dies from fully closing. Hence, the configuration shown in FIGS. 3–5 also prevents a corresponding fold up of the seal material.

With further reference to the embodiment of FIGS. 3–5, it will be noted that the opposite side portions of each of the swage dies 40*a*–40*f* have outer side surfaces 51 and 53. The outer side surfaces 51 and 53 converge radially inwardly to the radially inner surface 46 at a first angle. Each of the side portions have notches 54 and 55 which extend from the apices 48*a* and 50*a* to the radially inner surface 46. The surfaces 48 and 50 form the bottom walls of the notches, and converge radially inwardly to the radially inner surface 46 at a second angle greater than the angle of convergence of the outer side surfaces 51 and 53 so that the notches are generally triangular. The notch 54 has a side wall 56 which cooperates with the outer side surface 51 to define at least a portion of a rib 57. The notch 55 has a side wall 58 which cooperates with the outer side surface 53 to define at least a portion of a second rib 59. The notches of each of the swage dies 40*a*–40*f* receive the ribs of the swage dies next adjacent thereto, and the ribs of each of the swage dies extend into the notches of the swage dies next adjacent thereto. The notches of each of the swage dies open through the face portion 52 and are generally L-shaped in cross-section (see FIG. 5).

Figure 6:
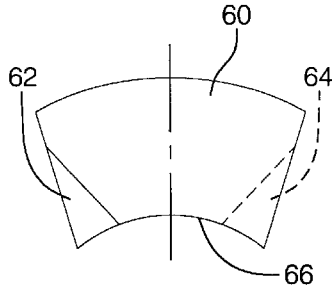
FIG. 6 is a view like FIG. 4 of alternate embodiment of the invention.
Figure 7:
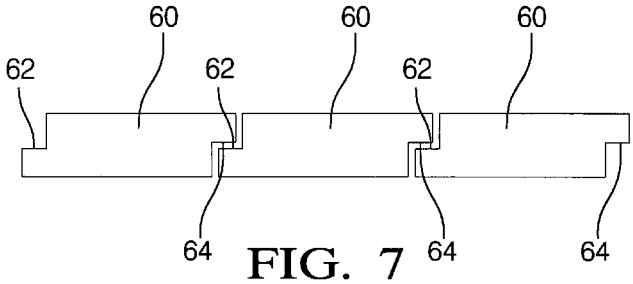
FIG. 7 is a view like FIG. 5 with the alternate embodiment of the invention shown in FIG. 6.

In the embodiment of the invention shown in FIG. 6 and 7, each of the dies 60 that are illustrated therein have side surfaces 62 and 64 formed on opposite faces of the die. The dies are overlapped in a circumferential direction as shown in FIG. 7, and will provide a full clamp ring contact at curve surfaces 66 on each of the die elements so as to reduce or eliminate a raised-up or non swage section of the clamp between the tool segments in accordance with the present invention.

Figure 8:
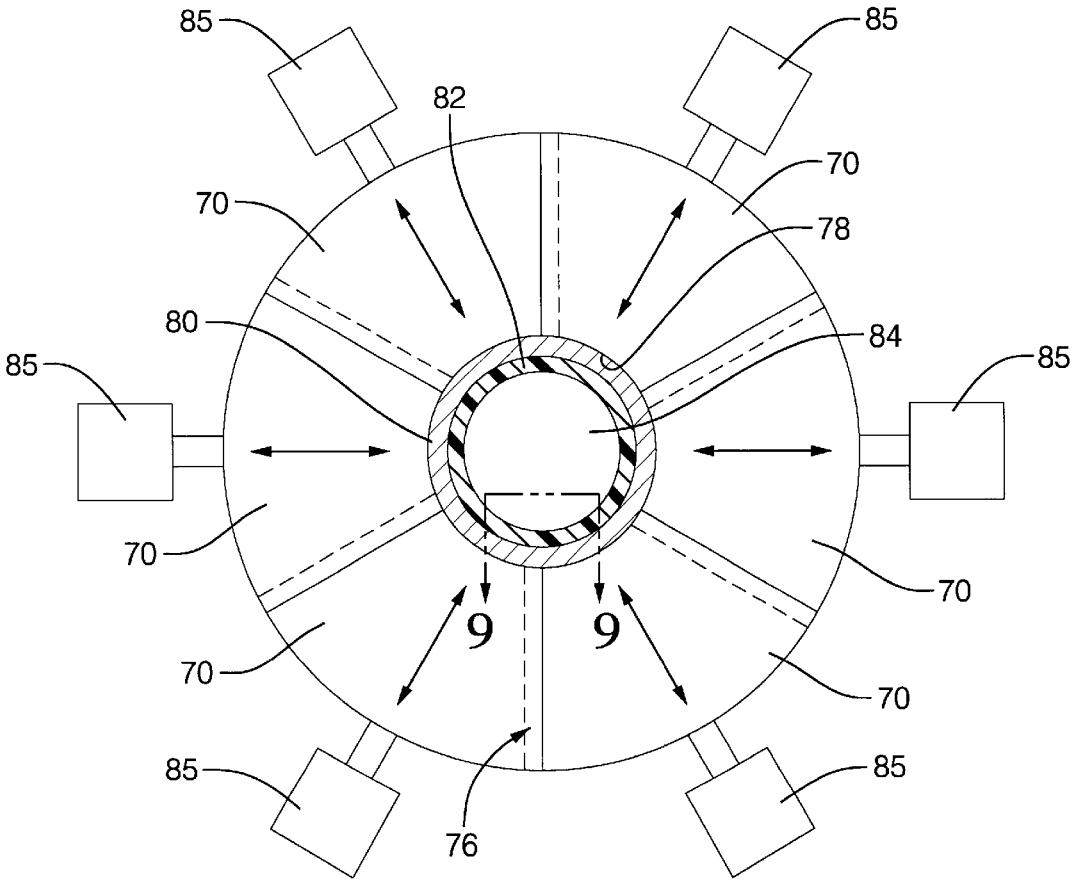
FIG. 8 is a diagrammatic view of another embodiment of the present invention.
Figure 9:
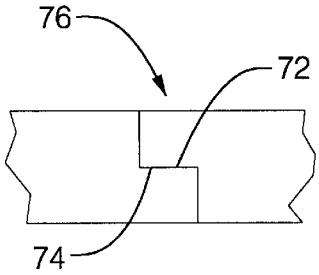
FIGS. 9 through 11 are fragmentary sectional views of three different embodiments of a side edge profile for use in the embodiment of the apparatus shown in FIG. 8.

A still further embodiment of the invention is shown in FIGS. 8–9 wherein a plurality of circumferentially located swage dies 70 are provided. Side surfaces 72, 74 on dies 70 will overlap either along the full length or on a partial segment of the length of each of the dies 70. As shown in FIG. 9, the side surfaces 72, 74 are formed as lap-joints 76. Each of swage dies 70 have a curve surface 78 thereon that fully contacts the outer circumference of a clamp ring 80 for compressing it and an underlying seal element 82 against a substrate 84.

Figure 10:
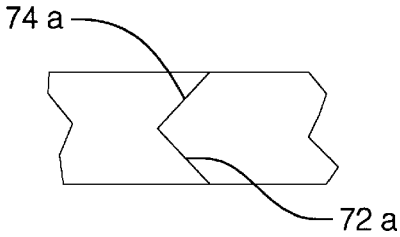

Another embodiment of the present invention is shown in FIG. 10, wherein the side surfaces 72, 74 are formed as V grooves 72*a* and V tips 74*a*. The non-straight edge form of the V prevents the fold up problem of the prior art.

Figure 11:
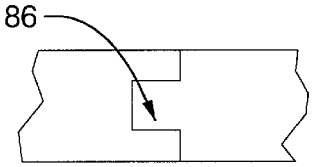

A still further embodiment of the invention is show in FIG. 11, wherein the side surfaces form a tongue-in-groove joint 86 with a non-straight edge that prevents fold up as described herein.

In each of embodiments shown in FIG. 8–11, the die edge surface configurations prevent clamp and/or seal fold up into a space between die segments since the die segments have side surfaces that are formed on a non-straight path. Thus in contrast of the prior art where the resilience seal material can fold along a straight line, in all of the other embodiments of the invention the fold must occur along shapes that prevent such fold up. In the embodiments of FIGS. 3–5 and 6 and 7 the overlapping segments are arranged when viewed around the circumference so that there will be no fold up because of the overlap therebetween.

I claim:

1. Apparatus for securing a seal to a substrate by a deformable ring clamp including a plurality of swage dies arranged circumferentially of the ring clamp having radially inwardly located surfaces engagable with the ring clamp and moveable with respect thereto for deforming the ring clamp against the seal for securing on the substrate characterized by:

each of said swage dies having opposite side portions, each of said side portions having an outer side surface, the outer side surfaces of the side portions of each of said swage dies converging radially inwardly to said radially inwardly located surface at a first angle, each of said side portions having a notch, each of the notches of each of said swage dies extending from an apex at a point on one of the outer side surfaces thereof to the radially inwardly located surface, each of said notches having a bottom wall extending from the apex thereof to said radially inwardly located surface, said bottom walls of the notches of each of said swage dies converging radially inwardly at a second angle greater than said first angle so that said notches are generally triangular, each of the notches of each of said swage dies having a side wall, one of which cooperates with the outer side surface of one of said side portions to define at least a portion of a first rib and the other of which cooperates with the outer side surface of the other of said side portions to define at least a portion of a second rib, the notches of each of said swage dies receiving the ribs of the swage dies next adjacent thereto, and the ribs of each of said swage dies extending into the notches of the swage dies next adjacent thereto.

2. The apparatus of claim 1, wherein each of said swage dies has a face, and the notches of each of said swage dies open through said face and are generally L-shaped in cross section.

3. The apparatus of claim 1, wherein each of said swage dies has opposite faces, and one of the notches of each of said swage dies opens through one of said faces and the other of the notches thereof opens through the other of said faces, said notches being generally L-shaped in cross section.

* * * * *